US011128050B1

(12) United States Patent
Chuang

(10) Patent No.: US 11,128,050 B1
(45) Date of Patent: Sep. 21, 2021

(54) ANTENNA STRUCTURE

(71) Applicant: Wistron Corp., New Taipei (TW)

(72) Inventor: Shih Ming Chuang, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 16/908,459

(22) Filed: Jun. 22, 2020

(30) Foreign Application Priority Data

May 14, 2020 (TW) ..... 109115965

(51) Int. Cl.

| | |
|---|---|
| ***H01Q 13/10*** | (2006.01) |
| *H01Q 13/12* | (2006.01) |
| *H01Q 1/38* | (2006.01) |
| *H01Q 9/00* | (2006.01) |
| *H01Q 21/30* | (2006.01) |
| *H01Q 1/24* | (2006.01) |

(52) U.S. Cl.
CPC ..... *H01Q 13/10* (2013.01); *H01Q 1/243* (2013.01); *H01Q 1/38* (2013.01); *H01Q 9/00* (2013.01); *H01Q 13/106* (2013.01); *H01Q 13/12* (2013.01); *H01Q 21/30* (2013.01)

(58) Field of Classification Search
CPC ..... H01Q 13/10; H01Q 13/12; H01Q 13/106; H01Q 1/243; H01Q 1/38; H01Q 21/30; H01Q 9/00
See application file for complete search history.

(56) References Cited

U.S. PATENT DOCUMENTS

| | | | |
|---|---|---|---|
| 10,069,196 B1 | 9/2018 | Yen et al. | |
| 2009/0135071 A1* | 5/2009 | Huang | H01Q 9/0421 343/700 MS |
| 2012/0194390 A1 | 8/2012 | Endo et al. | |
| 2013/0154888 A1 | 6/2013 | Lin et al. | |
| 2014/0253398 A1 | 9/2014 | Hsieh et al. | |
| 2016/0156101 A1 | 6/2016 | Tsai et al. | |

FOREIGN PATENT DOCUMENTS

| | | |
|---|---|---|
| EP | 2 942 834 A1 | 11/2015 |
| TW | 201715791 A | 5/2017 |

OTHER PUBLICATIONS

European Search Report dated Jan. 21, 2021, issued in application No. EP 20188176.0.
Chinese language office action dated Dec. 18, 2020, issued in application No. TW 109115965.

* cited by examiner

*Primary Examiner* — Joseph J Lauture
(74) *Attorney, Agent, or Firm* — McClure, Qualey & Rodack, LLP

(57) ABSTRACT

An antenna structure includes a ground element, a feeding radiation element, a first radiation element, a second radiation element, a third radiation element, and a switch circuit. The ground element provides a ground voltage. The feeding radiation element has a feeding point. The feeding radiation element is coupled through the first radiation element to the second radiation element. The third radiation element is coupled to the feeding radiation element. The feeding radiation element is disposed between the first radiation element and the third radiation element. The switch circuit selectively couples the second radiation element to the ground voltage according to a control voltage. A slot is formed and surrounded by the ground element, the feeding radiation element, the first radiation element, and the second radiation element.

20 Claims, 6 Drawing Sheets

ANTENNA STRUCTURE

CROSS REFERENCE TO RELATED APPLICATIONS

This application claims priority of Taiwan Patent Application No. 109115965 filed on May 14, 2020, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

BRIEF SUMMARY OF THE INVENTION

In an exemplary embodiment, the invention is directed to An antenna structure includes a ground element, a feeding radiation element, a first radiation element, a second radiation element, a third radiation element, and a switch circuit. The ground element provides a ground voltage. The feeding radiation element has a feeding point. The feeding radiation element is coupled through the first radiation element to the second radiation element. The third radiation element is coupled to the feeding radiation element. The feeding radiation element is disposed between the first radiation element and the third radiation element. The switch circuit selectively couples the second radiation element to the ground voltage according to a control voltage. A slot is formed and surrounded by the ground element, the feeding radiation element, the first radiation element, and the second radiation element.

In some embodiments, the antenna structure further includes a dielectric substrate. The ground element, the feeding radiation element, the first radiation element, the second radiation element, and the third radiation element are disposed on the dielectric substrate.

In some embodiments, the first radiation element and the second radiation element are positioned at the same side of the feeding radiation element. The third radiation element is positioned at the opposite side of the feeding radiation element.

In some embodiments, the feeding radiation element substantially has a straight-line shape.

In some embodiments, the first radiation element substantially has an L-shape.

In some embodiments, the first radiation element includes a narrow portion and a wide portion which are coupled to each other.

In some embodiments, the second radiation element substantially has a straight-line shape.

In some embodiments, the second radiation element further includes a corner widening portion.

In some embodiments, the third radiation element substantially has a rectangular shape.

In some embodiments, the slot substantially has an L-shape.

In some embodiments, if the switch element does not couple the second radiation element to the ground voltage, the antenna structure will cover a first frequency band. If the switch element couples the second radiation element to the ground voltage, the antenna structure will cover a second frequency band.

In some embodiments, the first frequency band is around 1575 MHz, and the second frequency band is from 2400 MHz to 2500 MHz.

In some embodiments, the antenna structure further covers a third frequency band and a fourth frequency band. The third frequency band is from 3300 MHz to 5000 MHz. The fourth frequency band is from 5150 MHz to 5850 MHz.

In some embodiments, the total length of the feeding radiation element, the first radiation element, and the second radiation element is shorter than or equal to 0.25 wavelength of the first frequency band.

In some embodiments, the length of the slot is shorter than or equal to 0.25 wavelength of the third frequency band.

In some embodiments, the width of the slot is from 0.5 mm to 3.5 mm.

In some embodiments, the total length of the feeding radiation element and the third radiation element is shorter than or equal to 0.25 wavelength of the fourth frequency band.

In some embodiments, the wide portion of the first radiation element further has an opening.

In some embodiments, the opening of the first radiation element substantially has a rectangular shape.

In some embodiments, the slot further extends into an interior of the wide portion of the first radiation element, such that the slot and the opening of the first radiation element are connected to each other.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
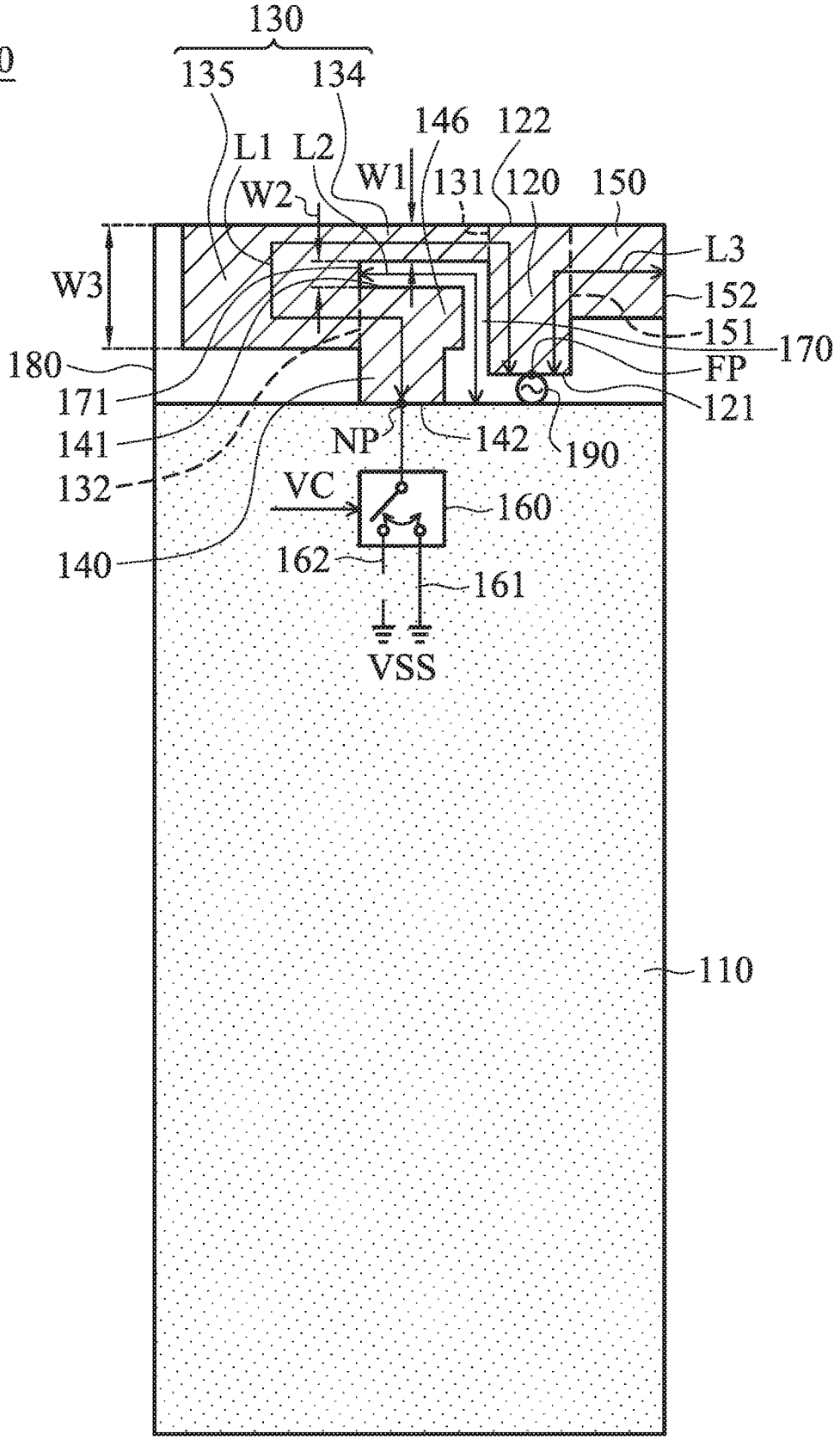
FIG. 1 is a diagram of an antenna structure according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a diagram of an antenna structure 100 according to an embodiment of the invention. The antenna structure 100 may be applied to a mobile device, such as a smartphone, a tablet computer, or a notebook computer. As shown in FIG. 1, the antenna structure 100 at least includes a ground element 110, a feeding radiation element 120, a first radiation element 130, a second radiation element 140, a third radiation element 150, and a switch circuit 160. The ground element 110, the feeding radiation element 120, the first radiation element 130, the second radiation element 140, and the third radiation element 150 may all be made of metal materials, such as copper, silver, aluminum, iron, or their alloys.

The ground element 110 may be a ground copper foil, which is configured to provide a ground voltage VSS. In some embodiments, the antenna structure 100 further includes a dielectric substrate 180. For example, the dielectric substrate 180 may be an FR4 (Flame Retardant 4) substrate, a PCB (Printed Circuit Board), or a FCB (Flexible Circuit Board). The ground element 110, the feeding radiation element 120, the first radiation element 130, the second radiation element 140, and the third radiation element 150 may form a planar structure, which may be disposed on the same surface of the dielectric substrate 180, but they are not limited thereto. In alternative embodiments, the ground element 110, the feeding radiation element 120, the first radiation element 130, the second radiation element 140, and the third radiation element 150 may be formed on a surface of a housing of a mobile device, and they are classified as a 3D (Three Dimensional) structure.

The feeding radiation element 120 may substantially have an equal-width straight-line shape. Specifically, the feeding radiation element 120 has a first end 121 and a second end 122. A feeding point FP is positioned at the first end 121 of the feeding radiation element 120. The feeding point FP may be further coupled to a signal source 190. For example, the signal source 190 may be an RF (Radio Frequency) module for exciting the antenna structure 100. The feeding radiation element 120 is disposed between the first radiation element 130 and the third radiation element 150. In some embodiments, the first radiation element 130 and the second radiation element 140 are positioned at the same side (e.g., the left side) of the feeding radiation element 120, and the third radiation element 150 is positioned at the opposite side (e.g., the right side) of the feeding radiation element 120, but they are not limited thereto.

The first radiation element 130 may substantially have a variable-width L-shape. Specifically, the first radiation element 130 has a first end 131 and a second end 132. The first end 131 of the first radiation element 130 is coupled to the second end 122 of the feeding radiation element 120. In some embodiments, the first radiation element 130 includes a narrow portion 134 and a wide portion 135 which are coupled to each other. The narrow portion 134 is adjacent to the first end 131 of the first radiation element 130. The wide portion 135 is adjacent to the second end 132 of the first radiation element 130. It should be noted that the term "adjacent" or "close" over the disclosure means that the distance (spacing) between two corresponding elements is smaller than a predetermined distance (e.g., 5 mm or shorter), or means that the two corresponding elements directly touch each other (i.e., the aforementioned distance/spacing therebetween is reduced to 0).

The second radiation element 140 may substantially have a variable-width straight-line shape. Specifically, the second radiation element 140 has a first end 141 and a second end 142. The first end 141 of the second radiation element 140 is coupled to the second end 132 of the first radiation element 130. A switch node NP is positioned at the second end 142 of the second radiation element 140. The feeding radiation element 120 is coupled through the first radiation element 130 to the second radiation element 140. In some embodiments, the second radiation element 140 further includes a corner widening portion 146, which is adjacent to its first end 141. The corner widening portion 146 of the second radiation element 140 may substantially have a rectangular shape or a square shape. However, the invention is not limited thereto. In alternative embodiments, the corner widening portion 146 is removable from the second radiation element 140, such that the second radiation element 140 substantially has an equal-width straight-line shape.

The third radiation element 150 may substantially have a rectangular shape or a square shape. Specifically, the third radiation element 150 has a first end 151 and a second end 152. The first end 151 of the third radiation element 150 is coupled to the second end 122 of the feeding radiation element 120. The second end 152 of the third radiation element 150 is an open end, which extends away from the feeding radiation element 120. The third radiation element 150 may be substantially perpendicular to the feeding radiation element 120. In some embodiments, the combination of the feeding radiation element 120 and the third radiation element 150 substantially has an L-shape.

The switch circuit 160 may be an SPDT (Single Port Double Throw) switch, which is switchable between a grounded path 161 and an open-circuited path 162. Specifically, the switch circuit 160 selectively couples the switch node NP (or the second radiation element 140) to the ground voltage VSS according to a control voltage VC. For example, if the control voltage VC has a high logic level (or a logic "1"), the switch circuit 160 may couple the switch node NP of the second radiation element 140 to the ground voltage VSS of the ground element 110 (i.e., the switch circuit 160 may select the aforementioned grounded path 161). Conversely, if the control voltage VC has a low logic level (or a logic "0"), the switch circuit 160 may not couple the switch node NP of the second radiation element 140 to the ground voltage VSS of the ground element 110 (i.e., the switch circuit 160 may select the aforementioned open-circuited path 162).

It should be noted that a non-metal slot 170 is formed and surrounded by the ground element 110, the feeding radiation element 120, the first radiation element 130, and the second radiation element 140. The slot 170 may substantially have an equal-width or variable-width L-shape. In some embodiments, the slot 170 has a closed end 171, which may be adjacent to the first end 141 of the second radiation element 140, and may also be adjacent to the junction point between the narrow portion 134 and the wide portion 135 of the first radiation element 130.

Figure 2:
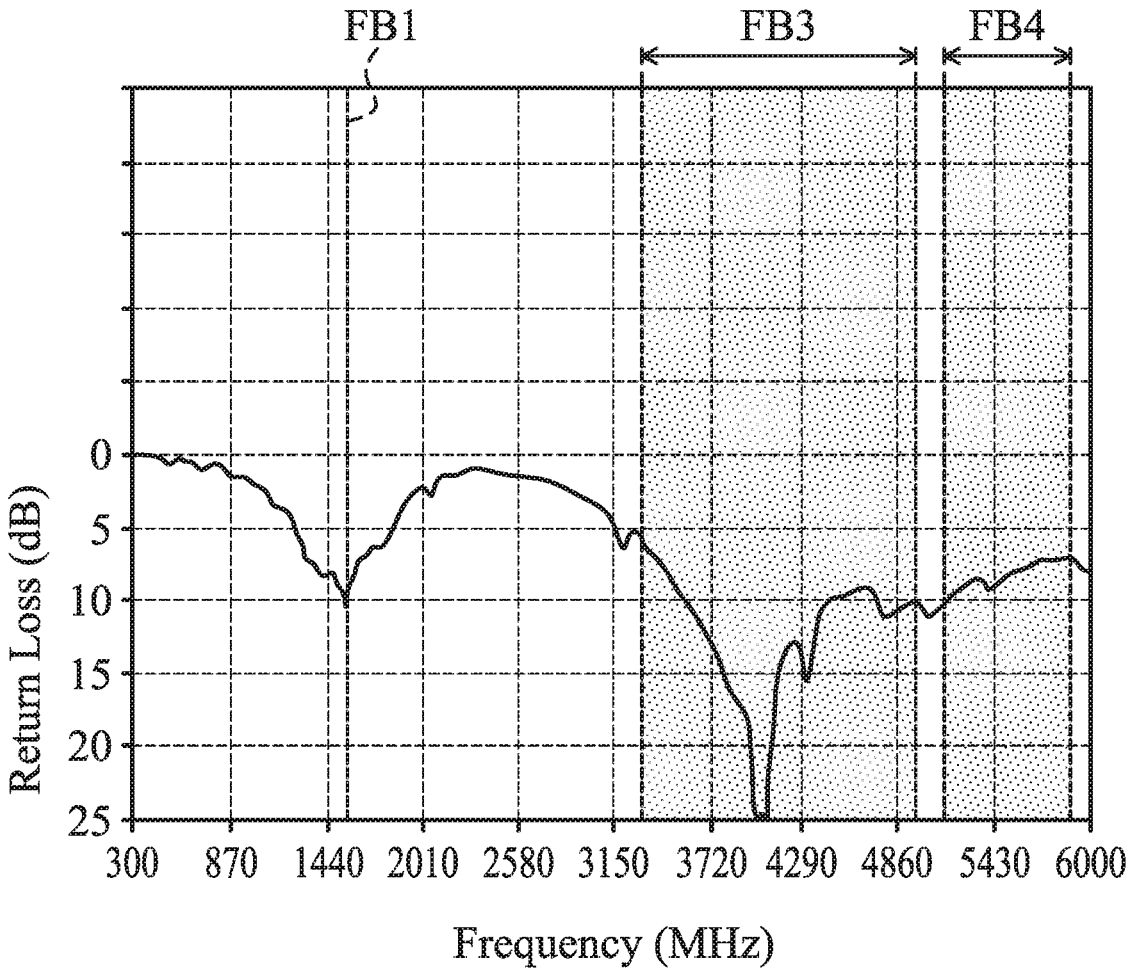
FIG. 2 is a diagram of return loss of an antenna structure according to an embodiment of the invention.

FIG. 2 is a diagram of return loss of the antenna structure 100 according to an embodiment of the invention. The horizontal axis represents the operation frequency (MHz), and the vertical axis represents the return loss (dB). According to the measurement of FIG. 2, if the switch circuit 160 does not couple the switch node NP of the second radiation element 140 to the ground voltage VSS (i.e., the open-circuited path 162 is selected), the antenna structure 100 can cover a first frequency band FB1, a third frequency band FB3, and a fourth frequency band FB4.

Figure 3:
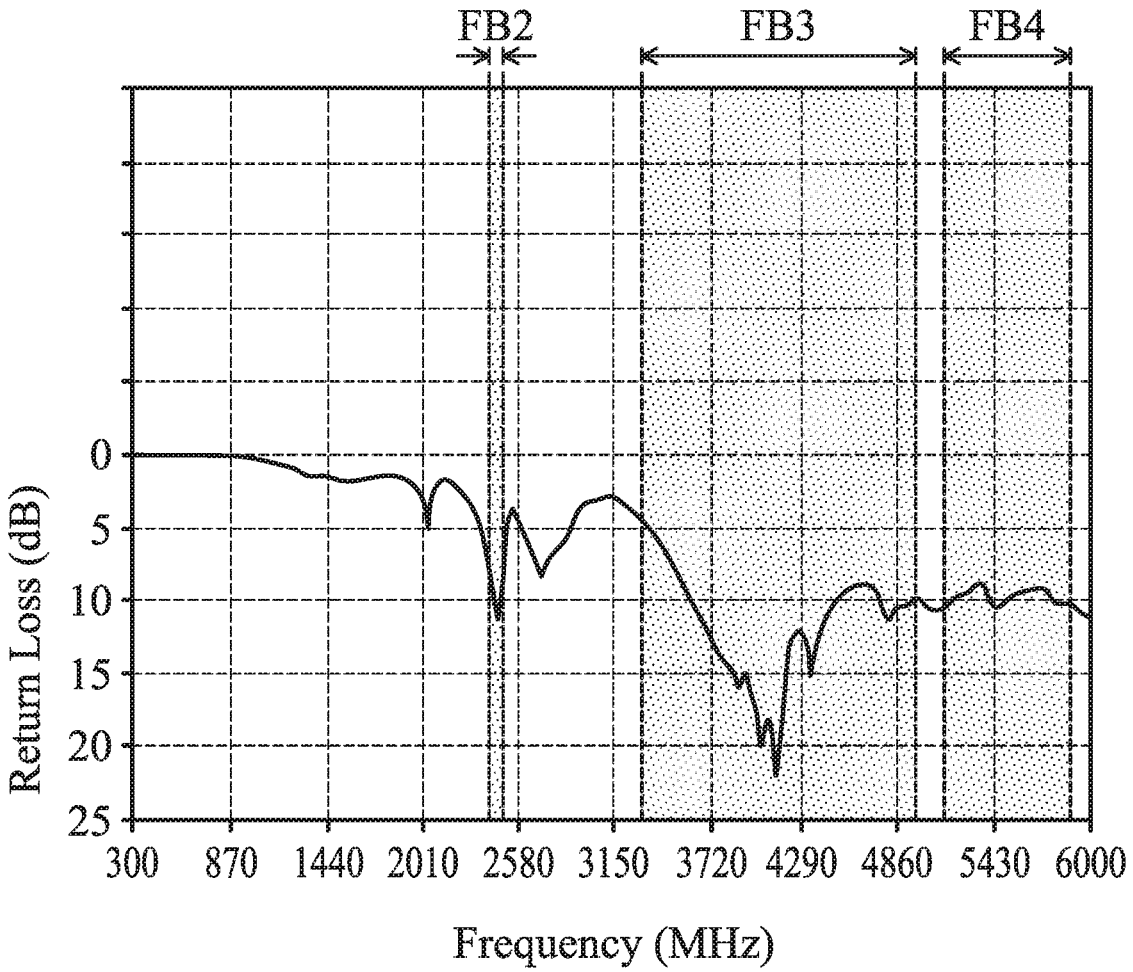
FIG. 3 is a diagram of return loss of an antenna structure according to another embodiment of the invention.

FIG. 3 is a diagram of return loss of the antenna structure 100 according to another embodiment of the invention. The horizontal axis represents the operation frequency (MHz), and the vertical axis represents the return loss (dB). According to the measurement of FIG. 3, if the switch circuit 160 couples the switch node NP of the second radiation element 140 to the ground voltage VSS (i.e., the grounded path 161 is selected), the antenna structure 100 can cover a second frequency band FB2, the third frequency band FB3, and the fourth frequency band FB4.

For example, the first frequency band FB1 may be around 1575 MHz, the second frequency band FB2 may be from 2400 MHz to 2500 MHz, the third frequency band FB3 may be from 3300 MHz to 5000 MHz, and the fourth frequency band FB4 may be from 5150 MHz to 5850 MHz. Therefore, by appropriately controlling the switch circuit 160, the antenna structure 100 can support at least the wideband operations of GPS (Global Positioning System), WLAN (Wireless Local Area Networks) 2.4 GHz/5 GHz, and sub-6 GHz frequency intervals of the next-generation 5G communications.

Figure 4:
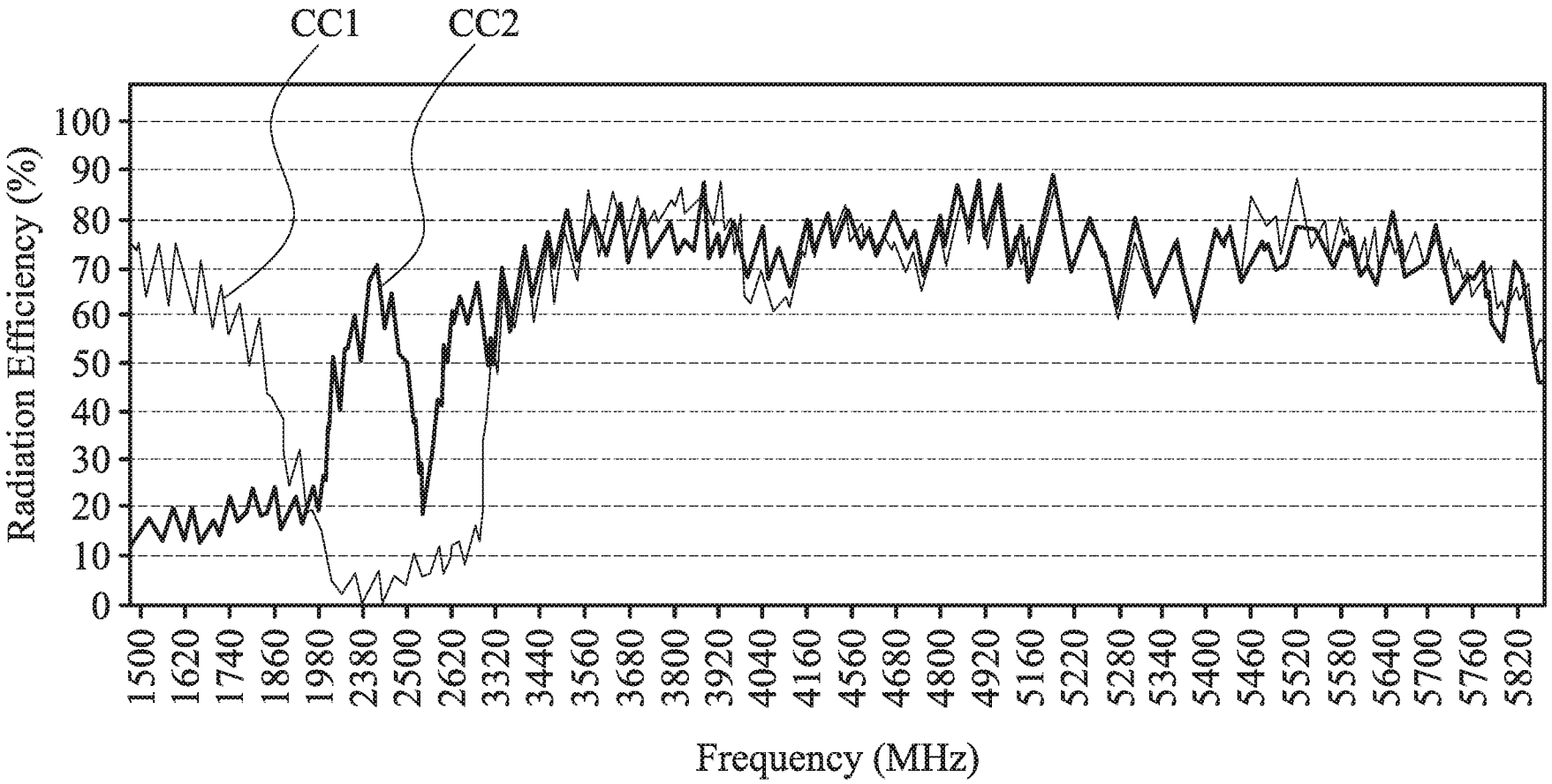
FIG. 4 is a diagram of radiation efficiency of an antenna structure according to an embodiment of the invention.

FIG. 4 is a diagram of radiation efficiency of the antenna structure 100 according to an embodiment of the invention. The horizontal axis represents the operation frequency (MHz), and the vertical axis represents the radiation efficiency (%). In the embodiment of FIG. 4, a first curve CC1 represents the radiation efficiency of the antenna structure 100 when the switch circuit 160 selects the open-circuited path 162, and a second curve CC2 represents the radiation efficiency of the antenna structure 100 when the switch circuit 160 selects the grounded path 161. According to the measurement of FIG. 4, by appropriately controlling the switch circuit 160, the radiation efficiency of the antenna structure 100 can be higher than 40% over the first frequency band FB1, the second frequency band FB2, the third frequency band FB3, and the fourth frequency band FB4, and it can meet the requirement of practical application of general mobile communication devices.

In some embodiments, the operation principles of the antenna structure 100 are described as follows. If the switch node NP of the second radiation element 140 is not coupled to the ground voltage VSS, the combination of the feeding radiation element 120, the first radiation element 130, and the second radiation element 140 will be considered as a monopole antenna, which can be excited to generate the first frequency band FB1. Conversely, if the switch node NP of the second radiation element 140 is coupled to the ground voltage VSS, the combination of the ground element 110, the feeding radiation element 120, the first radiation element 130, and the second radiation element 140 will be considered as a loop antenna, which can be excited to generate the second frequency band FB2. Furthermore, the slot 170 can be additionally excited to generate the third frequency band FB3. The feeding radiation element 120 and the third radiation element 150 can be excited to generate the fourth frequency band FB4. The corner widening portion 146 of the second radiation element 140 can increase the radiation efficiency of the antenna structure 100 in the fourth frequency band FB4.

In some embodiments, the element sizes of the antenna structure 100 are described as follows. The total length L1 of the feeding radiation element 120, the first radiation element 130, and the second radiation element 140 may be shorter than or equal to 0.25 wavelength ($\lambda/4$) of the first frequency band FB1 of the antenna structure 100. For example, the total length L1 may be from 0.15 to 0.17 wavelength ($0.15\lambda 0.17\lambda$) of the first frequency band FB1 of the antenna structure 100. The length L2 of the slot 170 may be shorter than or equal to 0.25 wavelength ($\lambda/4$) of the third frequency band FB3 of the antenna structure 100. For example, the length L2 may be from 0.15 to 0.17 wavelength ($0.15\lambda$~$0.17\lambda$) of the third frequency band FB3 of the antenna structure 100. The width W2 of the slot 170 may be from 0.5 mm to 3.5 mm. The total length L3 of the feeding radiation element 120 and the third radiation element 150 may be shorter than or equal to 0.25 wavelength ($\lambda/4$) of the fourth frequency band FB4 of the antenna structure 100. For example, the total length L3 may be from 0.15 to 0.17 wavelength ($0.15\lambda$~$0.17\lambda$) of the fourth frequency band FB4 of the antenna structure 100. In the first radiation element 130, the width W3 of the wide portion 135 may be at least 3 times the width W1 of the narrow portion 134. The above ranges of element sizes are calculated and obtained according to many experiment results, and they help to optimize the operation bandwidth and impedance matching of the antenna structure 100.

Figure 5:
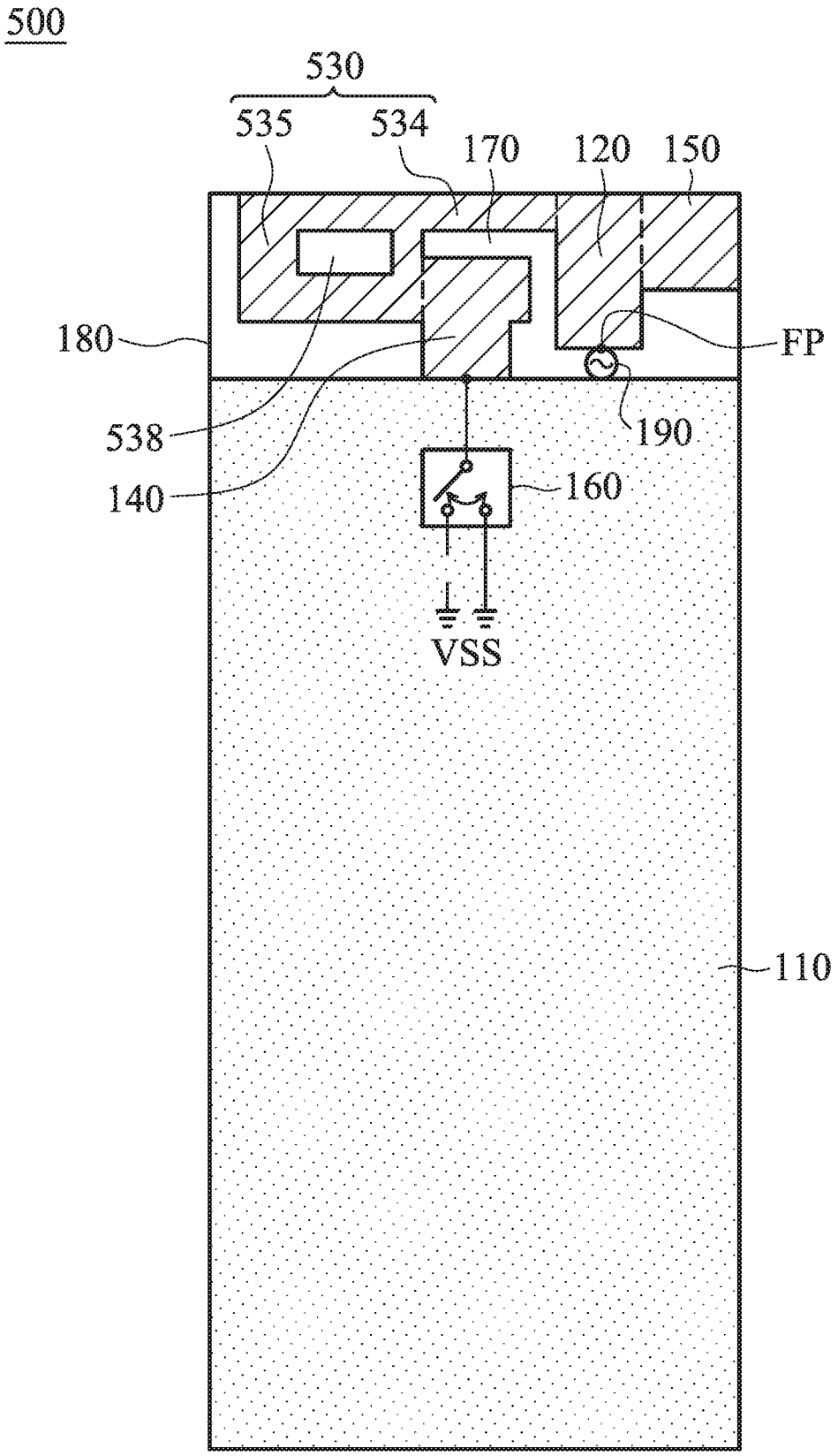
FIG. 5 is a diagram of an antenna structure according to another embodiment of the invention.

FIG. 5 is a diagram of an antenna structure 500 according to another embodiment of the invention. FIG. 5 is similar to FIG. 1. In the embodiment of FIG. 5, a first radiation element 530 of the antenna structure 500 includes a narrow portion 534 and a wide portion 535, and the wide portion 535 further has a non-metal opening 538. For example, the opening 538 of the first radiation element 530 may substantially have a rectangular shape, but it is not limited thereto. In alternative embodiments, the opening 538 of the first radiation element 530 may substantially have a square shape, a triangular shape, a circular shape, an elliptical shape, or a trapezoidal shape. According to practical measurements, the incorporation of the opening 538 can help to fine-tune the impedance matching of the first frequency band FB1 and the second frequency band FB2 of the antenna structure 500. Other features of the antenna structure 500 of FIG. 5 are similar to those of the antenna structure 100 of FIG. 1. Accordingly, the two embodiments can achieve similar levels of performance.

Figure 6:
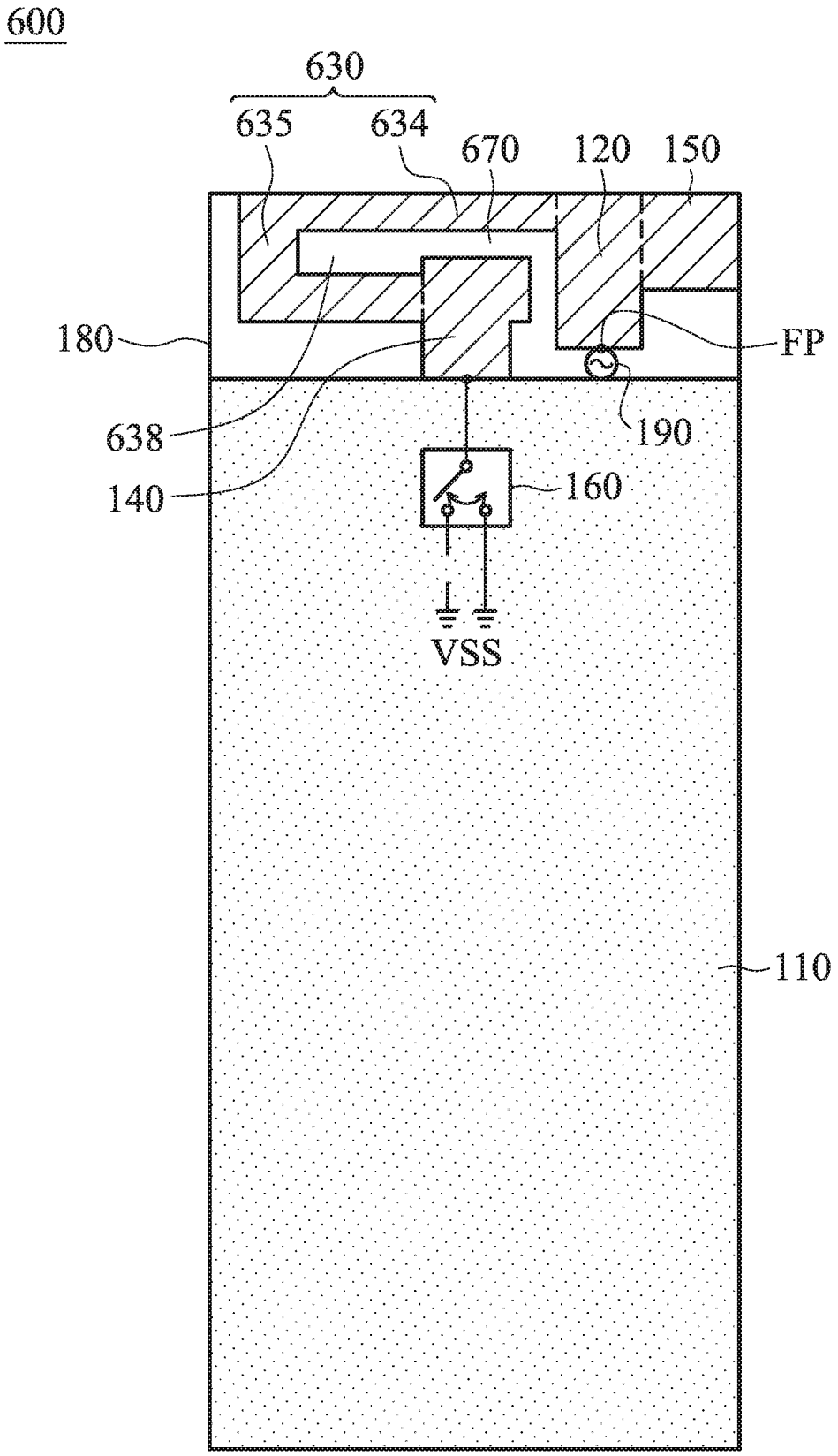
FIG. 6 is a diagram of an antenna structure according to another embodiment of the invention.

FIG. 6 is a diagram of an antenna structure 600 according to another embodiment of the invention. FIG. 6 is similar to FIG. 1. In the embodiment of FIG. 6, a first radiation element 630 of the antenna structure 600 includes a narrow portion 634 and a wide portion 635, and the wide portion 635 further has an opening 638. Furthermore, a slot 670 of the antenna structure 600 further extends into the interior of the wide portion 635 of the first radiation element 630, such that the slot 670 and the opening 638 of the first radiation element 630 are connected to each other. The combination of the opening 638 and the slot 670 may substantially have an equal-width or variable-width L-shape. According to practical measurements, the combination of the opening 638 and the slot 670 can help to fine-tune the impedance matching of the third frequency band FB3 of the antenna structure 600. Other features of the antenna structure 600 of FIG. 6 are similar to those of the antenna structure 100 of FIG. 1. Accordingly, the two embodiments can achieve similar levels of performance.

The invention proposes a novel antenna structure. In comparison to the conventional design, the invention has at least the advantages of small size, wide bandwidth, simple structure, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-6. The invention may include any one or more features of any one or more embodiments of FIGS. 1-6. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a ground element, providing a ground voltage;

a feeding radiation element, having a feeding point;

a first radiation element;

a second radiation element, wherein the feeding radiation element is coupled through the first radiation element to the second radiation element;

a third radiation element, coupled to the feeding radiation element, wherein the feeding radiation element is disposed between the first radiation element and the third radiation element; and a switch element, selectively coupling the second radiation element to the ground voltage according to a control voltage;

wherein a slot is formed and surrounded by the ground element, the feeding radiation element, the first radiation element, and the second radiation element.

2. The antenna structure as claimed in claim 1, further comprising:

a dielectric substrate, wherein the ground element, the feeding radiation element, the first radiation element, the second radiation element, and the third radiation element are disposed on the dielectric substrate.

3. The antenna structure as claimed in claim 1, wherein the first radiation element and the second radiation element are positioned at a side of the feeding radiation element, and the third radiation element is positioned at an opposite side of the feeding radiation element.

4. The antenna structure as claimed in claim 1, wherein the feeding radiation element substantially has a straight-line shape.

5. The antenna structure as claimed in claim 1, wherein the first radiation element substantially has an L-shape.

6. The antenna structure as claimed in claim 1, wherein the first radiation element comprises a narrow portion and a wide portion coupled to each other.

7. The antenna structure as claimed in claim 6, wherein the wide portion of the first radiation element further has an opening.

8. The antenna structure as claimed in claim 7, wherein the opening of the first radiation element substantially has a rectangular shape.

9. The antenna structure as claimed in claim 7, wherein the slot further extends into an interior of the wide portion of the first radiation element, such that the slot and the opening of the first radiation element are connected to each other.

10. The antenna structure as claimed in claim 1, wherein the second radiation element substantially has a straight-line shape.

11. The antenna structure as claimed in claim 1, wherein the second radiation element further comprises a corner widening portion.

12. The antenna structure as claimed in claim 1, wherein the third radiation element substantially has a rectangular shape.

13. The antenna structure as claimed in claim 1, wherein the slot substantially has an L-shape.

14. The antenna structure as claimed in claim 1, wherein if the switch element does not couple the second radiation element to the ground voltage, the antenna structure covers a first frequency band, and if the switch element couples the second radiation element to the ground voltage, the antenna structure covers a second frequency band.

15. The antenna structure as claimed in claim 14, wherein the first frequency band is around 1575 MHz, and the second frequency band is from 2400 MHz to 2500 MHz.

16. The antenna structure as claimed in claim 14, wherein the antenna structure further covers a third frequency band and a fourth frequency band, the third frequency band is from 3300 MHz to 5000 MHz, and the fourth frequency band is from 5150 MHz to 5850 MHz.

17. The antenna structure as claimed in claim 16, wherein a length of the slot is shorter than or equal to 0.25 wavelength of the third frequency band.

18. The antenna structure as claimed in claim 16, wherein a total length of the feeding radiation element and the third radiation element is shorter than or equal to 0.25 wavelength of the fourth frequency band.

19. The antenna structure as claimed in claim 14, wherein a total length of the feeding radiation element, the first radiation element, and the second radiation element is shorter than or equal to 0.25 wavelength of the first frequency band.

20. The antenna structure as claimed in claim 1, wherein a width of the slot is from 0.5 mm to 3.5 mm.

* * * * *